US012448905B2

(12) United States Patent
Andrisani et al.

(10) Patent No.: US 12,448,905 B2
(45) Date of Patent: Oct. 21, 2025

(54) VALVE BRIDGE WITH INTEGRATED SPLINE BUSHING FOR LOST MOTION AND ENGINE BRAKE

(71) Applicant: EATON INTELLIGENT POWER LIMITED, Dublin (IE)

(72) Inventors: Nicola Andrisani, Turin (IT); Emanuele Raimondi, Turin (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 18/845,150

(22) PCT Filed: Mar. 15, 2023

(86) PCT No.: PCT/EP2023/025115

§ 371 (c)(1),
(2) Date: Sep. 9, 2024

(87) PCT Pub. No.: WO2023/174580

PCT Pub. Date: Sep. 21, 2023

(65) Prior Publication Data

US 2025/0075643 A1 Mar. 6, 2025

Related U.S. Application Data

(60) Provisional application No. 63/319,902, filed on Mar. 15, 2022.

(51) Int. Cl.
*F02D 13/04* (2006.01)
*F01L 1/18* (2006.01)
(Continued)

(52) U.S. Cl.
CPC ..... *F01L 1/181* (2013.01); *F01L 1/267* (2013.01); *F01L 13/0005* (2013.01); *F01L 13/065* (2013.01); *F01L 2013/001* (2013.01)

(58) Field of Classification Search
CPC ..... F01L 1/181; F01L 13/06; F01L 2001/467; F01L 2305/00; F01L 2013/001; F01L 1/18; F01L 1/2411; F01L 1/2416; F02D 13/04
(Continued)

(56) References Cited

U.S. PATENT DOCUMENTS 6,386,160 B1 5/2002 Meneely
11,619,149 B2 * 4/2023 Taylor ..... F01L 1/181 123/90.46
(Continued)

FOREIGN PATENT DOCUMENTS

DE 112020000513 10/2021
WO 2020253993 12/2020
(Continued)

OTHER PUBLICATIONS

International Search Report and Written Opinion for PCT/EP2023/025115 dated Jun. 7, 2023, 9 pages.

*Primary Examiner* — Logan M Kraft
*Assistant Examiner* — James J Kim
(74) *Attorney, Agent, or Firm* — Meunier Carlin & Curfman LLC

(57) ABSTRACT

A rocker arm assembly for an engine including a main body rotatable about a shaft. The main body has a roller end and a valve end. A first switchable castellation assembly is disposed in the valve end. The first switchable castellation assembly has a distal end configured to selectively move a first valve. A second switchable castellation assembly is disposed in the valve end. The second switchable castellation assembly has a distal end configured to engage a valve bridge assembly. The valve bridge assembly is configured for engaging and actuating a second valve.

18 Claims, 5 Drawing Sheets

(51) Int. Cl.
*F01L 1/26* (2006.01)
*F01L 13/00* (2006.01)
*F01L 13/06* (2006.01)

(58) Field of Classification Search
USPC ..... 123/321
See application file for complete search history.

(56) References Cited

U.S. PATENT DOCUMENTS

| | | | | |
|---|---|---|---|---|
| 11,686,224 | B2 * | 6/2023 | Edke | F01L 1/181 123/90.16 |
| 2018/0187579 | A1 | 7/2018 | Cecur | |
| 2019/0178113 | A1 * | 6/2019 | McCarthy, Jr. | F01L 13/065 |
| 2020/0325803 | A1 * | 10/2020 | Patil | F01L 1/181 |
| 2021/0285343 | A1 * | 9/2021 | VanWingerden | F01L 9/20 |
| 2021/0372299 | A1 * | 12/2021 | Edke | F01L 1/267 |
| 2023/0184144 | A1 * | 6/2023 | Saggam | F01L 1/18 123/90.39 |

FOREIGN PATENT DOCUMENTS

| | | | | |
|---|---|---|---|---|
| WO | WO-2020253993 | A1 * | 12/2020 | F01L 1/181 |
| WO | 2021164950 | | 8/2021 | |
| WO | 2021213703 | | 10/2021 | |
| WO | 2022083896 | | 4/2022 | |
| WO | 2022218573 | | 10/2022 | |

* cited by examiner

VALVE BRIDGE WITH INTEGRATED SPLINE BUSHING FOR LOST MOTION AND ENGINE BRAKE

PRIORITY

This application claims the benefit of priority of U.S. provisional patent application Ser. No. 63/319,902, filed Mar. 15, 2022, the contents of which are incorporated herein by reference in their entirety.

FIELD

The subject application relates to, in general, a valve bridge for use in a valve train assembly. More particularly, this application relates to a valve bridge configured for valve deactivation and engine brake.

BACKGROUND

Many internal combustion engines utilize rocker arms to transfer rotational motion of cams to linear motion appropriate for opening and closing engine valves. Deactivating a valve allows the rocker arm to move without transferring motion to the valve.

The present application provides an apparatus for deactivating valves for cylinder deactivation and engine braking (EB).

SUMMARY OF THE INVENTION

There is provided a rocker arm assembly for an engine including a main body rotatable about a shaft. The main body has a roller end and a valve end. A first switchable castellation assembly is disposed in the valve end. The first switchable castellation assembly has a distal end configured to selectively move a first valve. A second switchable castellation assembly is disposed in the valve end. The second switchable castellation assembly has a distal end configured to engage a valve bridge assembly. The valve bridge assembly is configured for engaging and actuating a second valve.

In the foregoing rocker arm assembly, the first valve is associated with an engine braking function.

In the foregoing rocker arm assembly, the valve bridge assembly is configured for engaging and actuating the first valve.

In the foregoing rocker arm assembly, the first valve and the second valve are associated with a cylinder deactivation function.

In the foregoing rocker arm assembly, the first valve is movable independent of the valve bridge assembly.

In the foregoing rocker arm assembly, the first switchable castellation assembly is positioned closer to the shaft than the second switchable castellation assembly.

In the foregoing rocker arm assembly, the first switchable castellation assembly and the second switchable castellation assembly each include a lost motion shaft. The lost motion shaft is configured to transfer a lift profile to a valve end. A switchable castellation device is also provided. The switchable castellation device includes a rotatable first spline bushing and a spline body. The first spline bushing is configured to switch between a locked position and an unlocked position. A lost motion is obtained by sliding the lost motion shaft when the first spline bushing is in the unlocked position.

In the foregoing rocker arm assembly, the rotatable first spline bushing of the first switchable castellation assembly has a height equal to a sum of a distance required for lost motion of the first valve during an engine braking function of the first valve and a distance required for lost motion of the first valve during a cylinder deactivation function of the first valve.

In the foregoing rocker arm assembly, the rotatable first spline bushing of the second switchable castellation assembly has a height equal to a sum of a distance required for lost motion of the second valve during a cylinder deactivation function of the second valve.

In the foregoing rocker arm assembly, a bottom surface of the first spline bushing is offset from an upper surface of the spline body by a distance required for lost motion of the second valve during an engine braking function of the first valve.

In the foregoing rocker arm assembly, a default position of the first spline bushing of the first switchable castellation assembly is the unlocked position.

In the foregoing rocker arm assembly, a default position of the first spline bushing of the second switchable castellation assembly is the locked position.

In the foregoing rocker arm assembly, the first switchable castellation assembly and the second switchable castellation assembly each further include a lost motion spring. The lost motion spring is configured to bias the lost motion shaft to a fully extended position. The lost motion spring also is configured to collapse during the lost motion.

In the foregoing rocker arm assembly, the first switchable castellation assembly and the second switchable castellation assembly each further include an actuator for rotating the first spline bushing between the locked position and the unlocked position.

There is also provided a method of operating a rocker arm assembly during an engine braking function and an engine braking lost motion function. The rocker arm assembly includes a main body rotatable about a shaft. The main body has a roller end and a valve end. A first switchable castellation assembly is disposed in the valve end. The first switchable castellation assembly has a distal end configured to selectively move a first valve. The first switchable castellation assembly is movable between a deactivated position wherein rotation of the main body about the shaft is not transferred to the first valve via the first switchable castellation assembly and an activated position wherein rotation of the main body about the shaft is transferred to the first valve via the first switchable castellation assembly. A second switchable castellation assembly is disposed in the valve end. The second switchable castellation assembly has a distal end configured to engage a valve bridge assembly. The valve bridge assembly is configured for engaging and actuating a second valve. The second switchable castellation assembly s movable between an activated position wherein rotation of the main body about the shaft is transferred to the second valve via the valve bridge assembly and the second switchable castellation assembly and a deactivated position wherein rotation of the main body about the shaft is not transferred to the second valve via the valve bridge assembly and the second switchable castellation assembly. The method includes for the engine braking function, 1) moving the first switchable castellation assembly to the activated position; and 2) rotating the main body a predetermined distance sufficient to actuate the first valve via the first switchable castellation assembly for the engine braking function wherein the second switchable castellation assembly internally collapses to prevent a transfer of motion to the valve bridge assembly via the second switchable castellation assembly. For the engine braking lost motion function, 1) moving the first switchable castellation assembly to the deactivated position; and 2) rotating the main body the predetermined distance sufficient to actuate the first valve via the first switchable castellation assembly for the engine braking function wherein the first switchable castellation assembly experiences lost motion and motion is not transferred to the first valve via the first switchable castellation assembly and wherein the second switchable castellation assembly internally collapses to prevent a transfer of motion to the valve bridge assembly via the second switchable castellation assembly.

In the foregoing method, further operating the rocker arm assembly during a normal operation mode and a cylinder deactivation function, including, for the normal operation mode: 1) moving the first switchable castellation assembly to the deactivated position and the second switchable castellation assembly to the activated position, and 2) rotating the main body a predetermined distance sufficient to actuate the second valve via the second switchable castellation assembly for the normal operation mode wherein the first switchable castellation assembly experiences lost motion and motion is not transferred to the first valve via the first switchable castellation assembly, and for the cylinder deactivation function: 1) moving the first switchable castellation assembly to the deactivated position and the second switchable castellation assembly to the deactivated position; and 2) rotating the main body the predetermined distance sufficient to actuate the second valve via the second switchable castellation assembly for the normal operation mode wherein the first valve experiences lost motion via the first switchable castellation assembly and the second valve experiences lost motion via the second switchable castellation assembly.

In the foregoing method, the first switchable castellation assembly and the second switchable castellation assembly each including a lost motion shaft. The lost motion shaft being configured to transfer a lift profile to a valve end. A switchable castellation device is also provided. The switchable castellation device includes a rotatable first spline bushing, and a spline body. The first spline bushing is configured to switch between a locked position and an unlocked position. A lost motion is obtained by sliding the lost motion shaft when the first spline bushing is in the unlocked position.

In the foregoing method, the rotatable first spline bushing of the first switchable castellation assembly has a height equal to a sum of a distance required for lost motion of the first valve during the engine braking lost motion function and a distance required for lost motion of the first valve during the cylinder deactivation function.

In the foregoing method, the rotatable first spline bushing of the second switchable castellation assembly has a height equal to a sum of a distance required for lost motion of the second valve during the cylinder deactivation function of the second valve.

In the foregoing method, the collapsing of the second switchable castellation assembly during the engine braking lost motion function is achieved by offsetting a bottom surface of the first spline bushing from an upper surface of the spline body a predetermined distance.

DETAILED DESCRIPTION

The following presents a description of the disclosure; however, aspects may be embodied in many different forms and should not be construed as limited to the embodiments set forth herein. Furthermore, the following examples may be provided alone or in combination with one or any combination of the examples discussed herein. Directional references such as "left" and "right" are for ease of reference to the figures.

Figure 1:
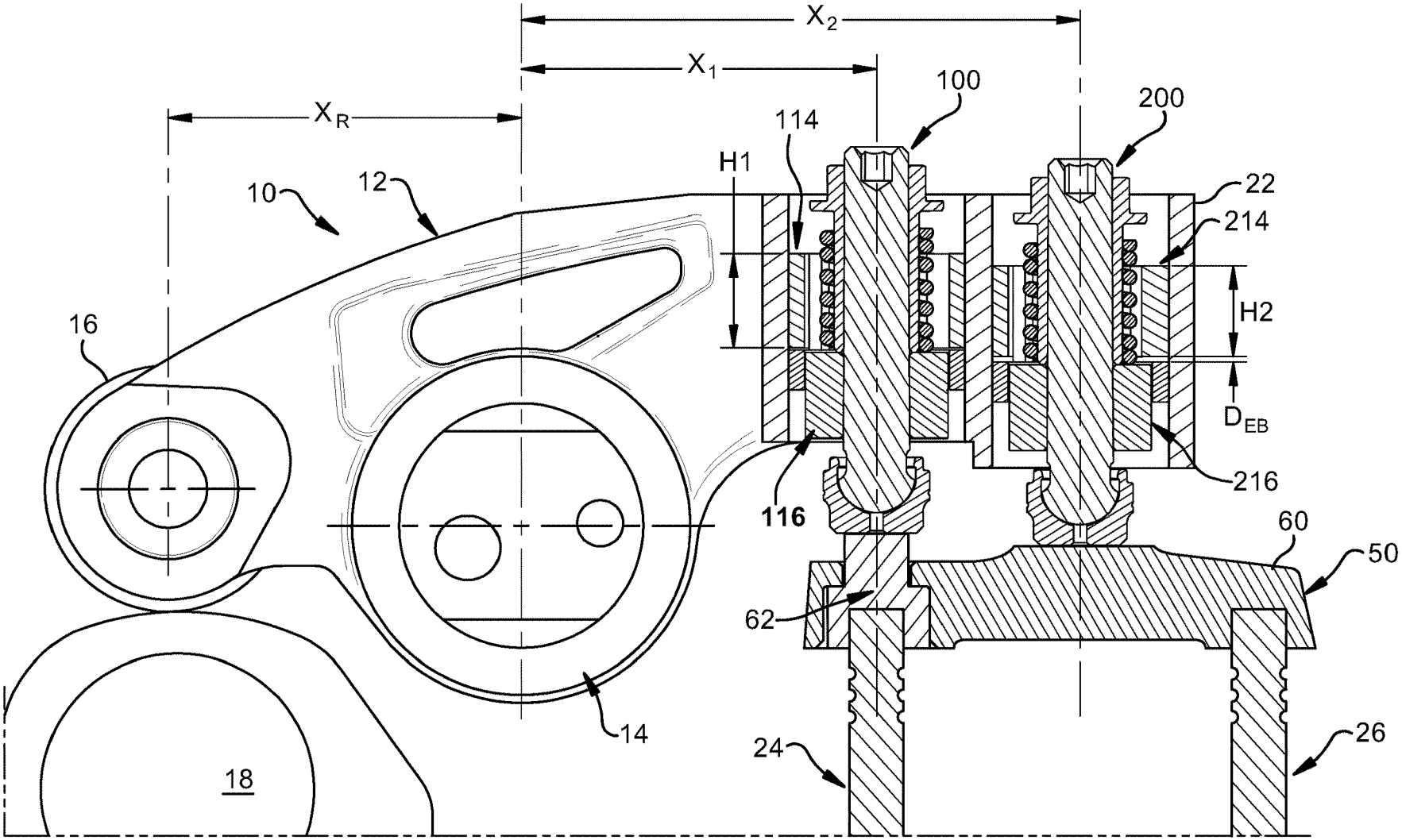
FIG. 1 is a perspective view of a rocker arm assembly having two integrated castellation assemblies.

With reference to FIG. 1, the rocker arm assembly 10 is shown to include a rocker arm 12 that is configured to rotate about a shaft 14. A roller end 16 of the rocker arm 12 is configured engage a cam 18 that causes the rocker arm 12 to rotate about the shaft 14. A valve end 22 of the rocker arm 12 is configured to selectively drive valves 24, 26 when the rocker arm 12 rotates about the shaft 14.

A valve bridge assembly 50 is configured to engage the valve end 22 of the rocker arm 12. A body 60 of the valve bridge assembly 50 is configured to engage the valves 24, 26 so that the valve bridge assembly 50 may transfer the rotational movement of the rocker arm 12 (FIG. 1) to vertical movement of the valves 24, 26.

A movable insert 62 is provided for allowing the valve 24 to move relative to the valve bridge assembly 50 during an engine braking process, as described in detail below. A first switchable castellation assembly 100 is provided for moving the valve 24 relative to the valve bridge assembly 50. A second switchable castellation assembly 200 is provided for moving both valves 24, 26, via the valve bridge assembly 50.

The switchable castellation assembly of PCT/EP2022/025147 is hereby incorporated herein in its entirety. The following is a brief description of the first and second switchable castellation assemblies 100, 200. For brevity, only the first switchable castellation assembly 100 is described hereinbelow. The second switchable castellation assembly 200 is identical to the first switchable castellation assembly 100, except for as noted below.

Figure 3:
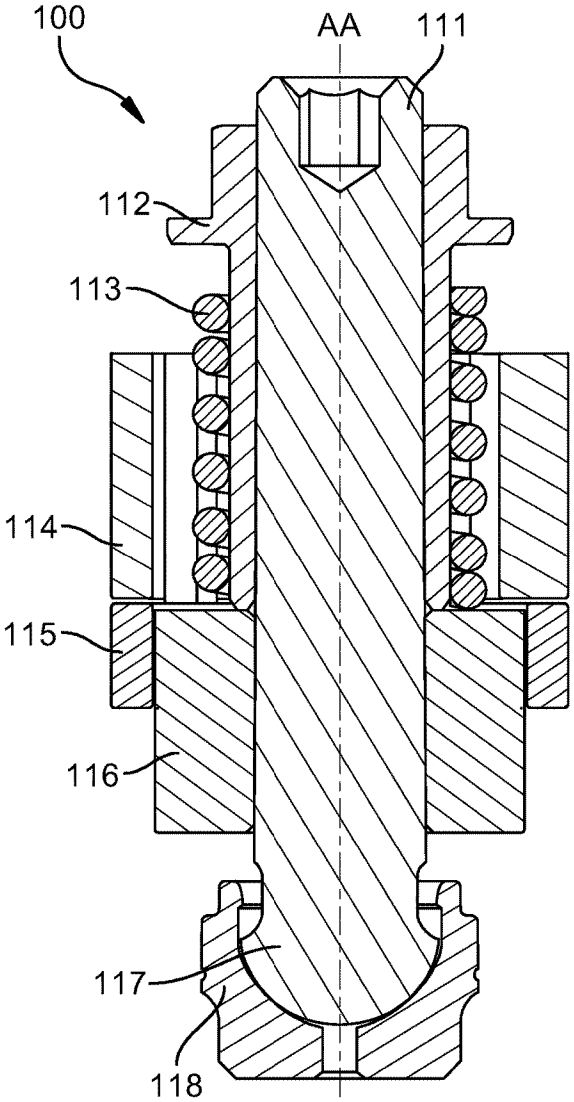
FIG. 3 is a section view of the castellation assembly of FIG. 2 taken along line 3-3.
Figure 2:
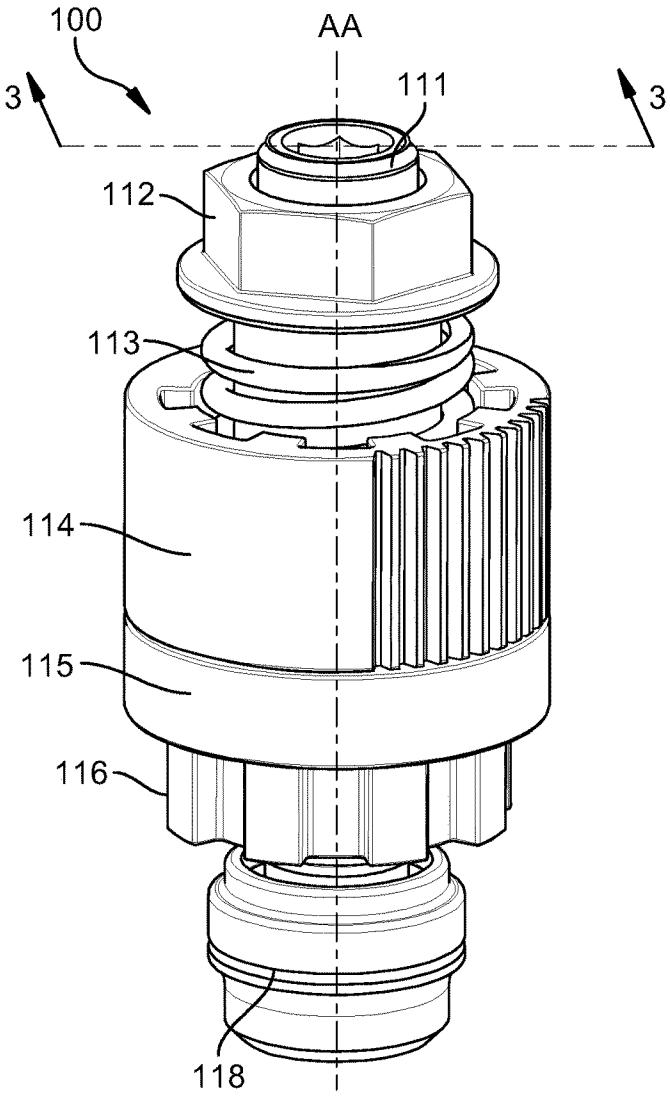
FIG. 2 is a perspective view of the castellation assembly of FIG. 1.

Referring to FIGS. 2 and 3 the first switchable castellation device 100 lies generally along an axis AA and includes a lost motion shaft 111, a lash regulation screw 112, a lost motion spring 113, a first spline bushing 114, a guide 115, and a spline body 116. Optionally, lost motion shaft 111 may comprise an end flare 117 on which an optional contact device 118 is mounted, for example, a press-foot, elephant foot, spigot, or similar device, may be mounted on one end of lost motion shaft 111 which may then contact the movable insert 62 or the valve bridge 50 (FIG. 1). The lash regulation screw 112 and the spline body 116 may be attached to lost motion shaft 111 via press, crush fit, threading, or other fasteners.

The lost motion shaft 111 is configured to transfer motion to the movable insert 62 or the valve bridge 50 (FIG. 1) and is configured to slide in a lost motion mode. The first spline bushing 114 is arranged to slide along at least a portion of the axial length of the lost motion shaft 111 along axis AA, as described in further detail below. The lash regulation screw 112 allows the amount of mechanical lash to be adjusted. The lost motion spring 113 is arranged along the axial length of the lost motion shaft 111, or otherwise sleeved on the lost motion shaft 111, and may absorb the motion of a valve lift event without causing a valve to open until a travel limit formed, for example, on the first switchable castellation device 100 itself or within the structure housing the first switchable castellation device 100 is reached.

Referring to FIG. 3, the first spline bushing 114 is a ring-shaped element having a first spline bore 131. The first spline bushing 114 has an inner diameter that is dimensioned to be larger than an outer diameter of the spline body 116 to accommodate axial movement of the spline body 116 through the first spline bushing 114. The first spline bushing 114 is slidable along an axial length of the lost motion shaft 111. The first spline bushing 114 further comprises a first actuator interface 132 arranged on, at least a portion of, the outer circumference of the first spline bushing 114. A first spline interface 133 is arranged on, at least a portion of, the inner circumference of first spline bushing 114. The first spline interface 133 is able to alternately allow the spline body 116 to slide into at least a portion of the first spline bushing 114 in one position, and to block the spline body 116 from sliding into at least a portion of the first spline bushing 114 in another position.

Figure 4:
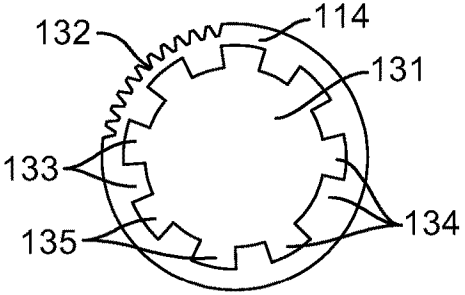
FIG. 4 is an end view of a first spline bushing of the castellation assembly of FIG. 2.

The first spline interface 133 is contoured to define mechanisms or features that allow the first spline bushing 114 to receive or block the spline body 116. The first spline interface 133 also includes a spline index 134 to receive a spline body index 153 of the spline body 116, as described in detail below. The first spline interface 133, including the optional spline index 134, is formed by a plurality of first spline grooves 135 running the axial length of the first spline bushing 114 and parallel to the lost motion shaft 111. When viewed from the top, as illustrated in FIG. 4, the grooves 135 appear as teeth and gaps which complement the spline body 116 to allow the first spline bushing 114 to receive at least some portion of the spline body 116 or prevent the first spline bushing 114 from receiving at least some portion of the spline body 116. While the first spline bushing 114 is generally illustrated in FIGS. 2-4 as a cylindrical ring, it is also contemplated that the first spline bushing 114 may have other shapes so long as the first spline bushing 114 slides along the lost motion shaft 111.

Figure 5:
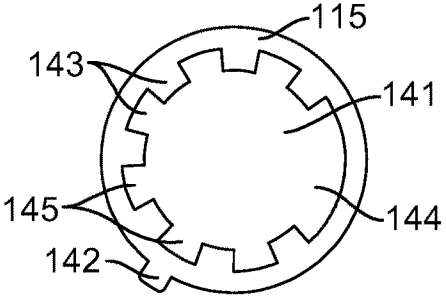
FIG. 5 is an end view of a guide of the castellation assembly of FIG. 2.

Referring to FIG. 5, the guide 115 comprises an angularly fixed ring having an inner diameter that is larger than the outer diameter of the spline body 116. The guide 115 includes a guide bore 141 that is configured to accommodate spline body 116. The guide 115 provides alignment for the spline body 116 relative to the first spline bushing 114, thereby preventing angular drift or movement of the spline body 16. The guide 115 further includes a guide notch 142 along, at least a portion of, the outer circumference of the guide 115, and a guide interface 143 arranged on, at least a portion of, the inner circumference of the guide 115.

While the guide notch 142 is shown as a rectangular protrusion the extends radially from an outer surface of the guide 115, it is contemplated that the guide notch 142 may have other shapes, or even an indentation or indentations rather than a protrusion, along at least some portion of the outer surface of the guide 115. The guide notch 142 may mate with a corresponding slot, groove, divot, tab, protrusion, or other feature on the rocker arm assembly 10 (FIG. 1).

The guide interface 143 is contoured to define features that allow the guide 115 to receive the spline body 116. The guide interface 143 also includes a guide index 144 for orienting the spline body 116 relative to the first spline bushing 114, as further described below. The guide interface 143, including the guide index 144, is formed by a plurality of guide grooves 145 that extend the axial length of the guide 115 and parallel to the lost motion shaft 111. When viewed from above, as illustrated in FIG. 5, the grooves 145 appear as teeth and gaps which align with the spline body 116 and allow the spline body 116 to slide through or pass through at least a portion of the guide 115. While the guide 115 is illustrated in FIGS. 2, 3 and 5 as being a cylindrical ring, it is contemplated that the guide 115 may have other shapes.

Figure 6:
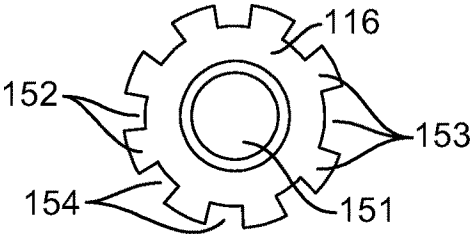
FIG. 6 is an end view of a spline body of the castellation assembly of FIG. 2.

Referring now to FIG. 6, the spline body 116 a ring-shaped body having a spline body bore 151 extending axially therethrough. The outer diameter of the spline body 116 is smaller than the inner diameter of the spline bushing 114 and the guide 115 so that the spline body 116 may slide axially through the spline bushing 114 and the guide 115. The spline body bore 151 is dimensioned to receive the lost motion shaft 111. As noted above, the spline body 116 may be fixed to the lost motion shaft 111 via threading or other fasteners. The spline body 116 may further include a spline body interface 152 along at least a portion of the outer circumference of the spline body 116. In one position, the spline body interface 152 allows the spline body 116 to slidably interact with at least a portion of the first spline bushing 114 and, in another position, the spline body interface 152 allows the spline body 116 to be blocked from sliding into the spline bushing 114.

The spline body interface 152 is contoured to define features that permit or block the spline body 116 from sliding through the spline bushing 114. The spline body interface 152 also includes a spline body index 153 for orienting the spline body 116 with the guide index 144 of the guide 115. The spline body interface 152, including the spline body index 153, is formed by a plurality of spline body grooves 154 that run along the axial length of the spline body 116 parallel to the lost motion shaft 111. As illustrated in FIG. 6, when viewed from above, the grooves 154 appear as teeth and gaps which complement the first spline interface 133 and the guide interface 143. The spline body index 153 may be a gap or tooth—or arrangement of teeth and gaps—which may slidably interact with the first spline index 134 and the guide index 144. Similarly, the guide index 144 is a complementary formation which may slidably interact with the spline body index 153. Likewise, the first spline index 134 is a complementary tooth or gap, or set of teeth and gaps, which may slidably interact with the spline body index 153.

While the first spline bushing 114, the guide 115, and the spline body 116 are illustrated as being cylindrical rings, it is contemplated that they may other shapes. Similarly, the first spline interface 133, the guide interface 143, and the spline body interface 152 are illustrated as being interlocking teeth with complementary spacing. It is contemplated that the foregoing features may have other interlocking configurations.

The spline body 116 remains within at least a portion of the guide 115 throughout its movement. This allows the guide 115 to maintain the angular orientation of the spline body 116. Keeping the spline body 116 sleeved within at least a portion of the guide 115, may be used alone or in conjunction with the indices 134, 144, 153 to maintain the angular orientation of the spline body 116.

The dimensions of the spline body 116 and the first spline bushing 114 as selected such that the grooves 135, 145, and 154 allow for the entirety of the spline body 116 to slide into the first spline bushing 114, thereby increasing the magnitude of motions that may be absorbed by the first switchable castellation device 100. The grooves 135, 145, and 154 also result in improved structural durability, thereby allowing the first spline bushing 114 and the spline body 116 to be constructed with greater axial length, in turn allowing the first switchable castellation device 100 to absorb a greater amount of lost motion.

Figure 7:
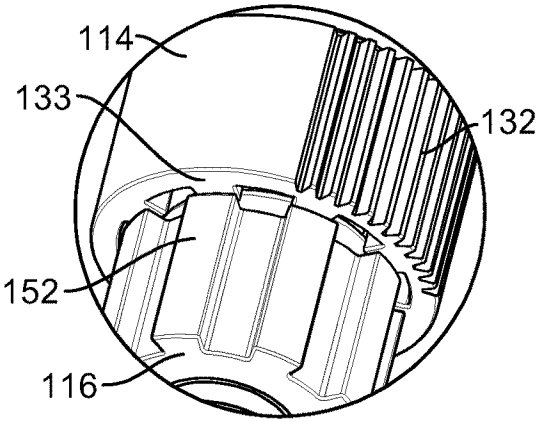
FIG. 7 is a perspective view of a first spline bushing and a spline body in a locked position.
Figure 8:
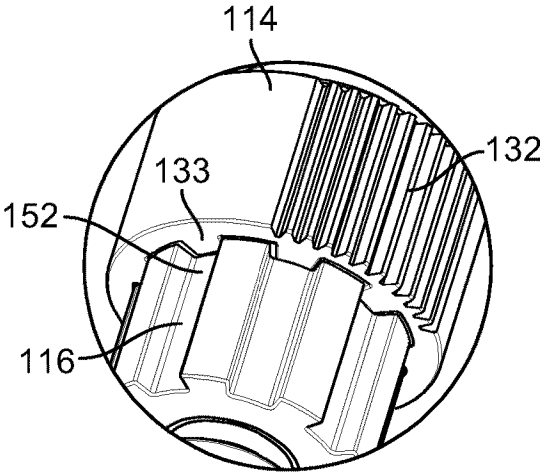
FIG. 8 is a perspective view of a first spline bushing and a spline body in an unlocked position.
Figure 9:
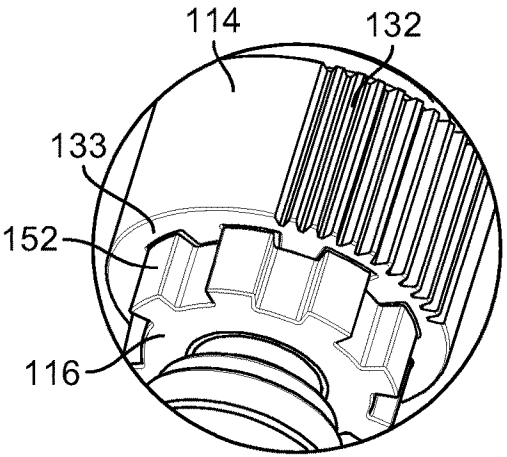
FIG. 9 is a perspective view of a first spline bushing and a spline body in the unlocked position and the spline body partially received into the first spline bushing.

FIGS. 7-9 illustrate the first spline bushing 114 interacting with the spline body 116. In these figures, the guide 115 is removed so that the view of the first spline bushing 114 and the spline body 116 is not obstructed. In FIG. 7, an actuator (not shown) has driven or engaged the first actuator interface 132 to rotate the first spline bushing 114 into a locked position. In the locked position, the first spline bushing 114 is oriented relative to the spline body 116 such that the first spline interface 133 aligns with the spline body interface 152 so the first spline interface 133 and the spline body interface 152 cannot slide past each other. Therefore, in the locked position, the first spline bushing 114 cannot slide into the spline body 116. This results in a short lost motion mode.

Referring now to FIG. 8, the actuator (not shown) has driven the first actuator interface 132 to rotate the first spline bushing 114 into an unlocked position. In this unlocked position, the first spline bushing 114 is oriented relative to the spline body 116 such that the first spline interface 133 aligns with the spline body interface 152 so the first spline interface 133 and the spline body interface 152 may slide past each other. Therefore, in the unlocked position, the first spline bushing 114 may slide into the spline body 116. This results in a long lost motion mode and the amount of lost motion absorbed is increased relative to the first switchable castellation device 100 in short lost motion mode.

Referring now to FIG. 9, the first spline bushing 114 is still in the unlocked position. When force is applied to the first switchable castellation device 100, the spline body 116 and the first spline bore 131 of the first spline bushing 114 are slid together. The lost motion spring 113 absorbs at least a portion of the incoming motion.

Figure 10:
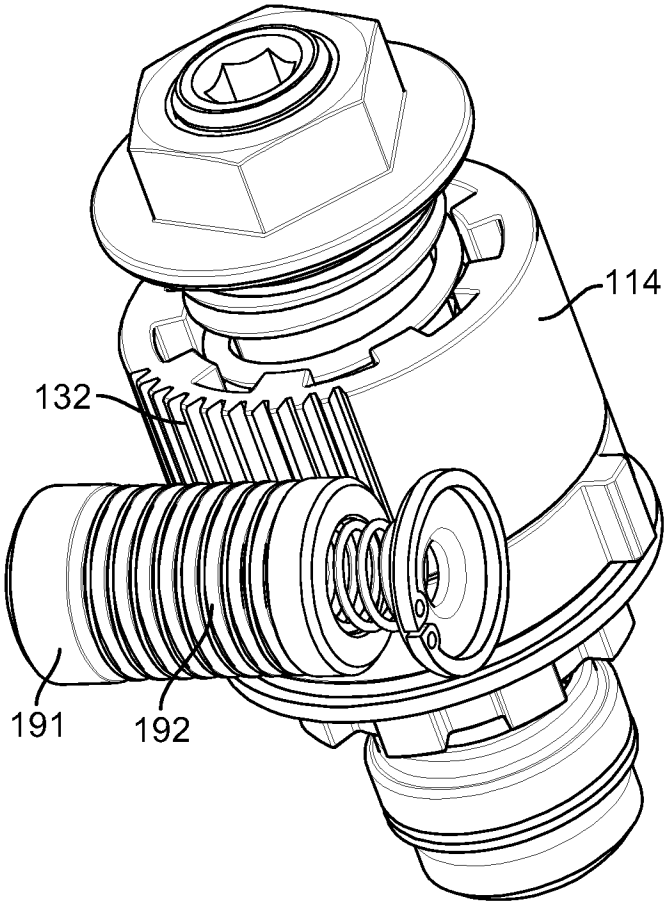
FIG. 10 is a perspective view of the castellation assembly of FIG. 2 with an actuator.

Referring now to FIG. 10, an optional actuator 191 is shown. The actuator 191 may be controlled hydraulically, pneumatically, or electromagnetically. In turn, the actuator 191 may drive or rotate the first spline bushing 114 in a clockwise or counterclockwise direction with a rack and pinion, though other actuation arrangements may also be used. The actuator 191 includes an interface 192 which mates with the first actuator interface 132 of the first spline bushing 114. Through the interface 192 and the first actuator interface 132, the actuator 191 may rotate the first spline bushing 114 to switch the first spline bushing 114 between locked or unlocked positions. Alternative actuators compatible herewith are described in, for example, WO2021213703, PCT/EP2021/025421, WO2021164950, which are hereby incorporated by reference in their entirety.

As noted above, the description of the second switchable castellation assembly 200 is identical to the description above for the first switchable castellation assembly 100 and is not repeated for brevity. Similar numbers, incremented by 200 are used below when referring to similar components of the second switchable castellation assembly 200.

Referring back to FIG. 1, the first and second switchable castellation assemblies 100, 200 are positioned in the same rocker arm assembly 10 so that the engine brake ("EB") function and cylinder deactivation ("CDA") function are integrate in a common rocker arm. The integrated arrangement finds particular application in a single overhead cam ("SOHC"), where the EB function is configured to open only valve 24, while in normal valve lift the rocker arm assembly 10 will open both valves 24, 26 via the valve bridge assembly 50.

The first switchable castellation assembly 100 is utilized for the EB function and the EB lost motion function and applies only to the valve 24. The first switchable castellation assembly 100 is positioned nearer the shaft 14 than the second switchable castellation assembly 200. The first switchable castellation assembly 100 is configured such that the default position of the first spline bushing 114 is the deactivated or unlocked position (FIGS. 8 and 9), as described in detail above. In this position, movement of the rocker arm 12 about the shaft 14 does not impart motion to the valve 24 via the first switchable castellation assembly 100.

Figure 11:
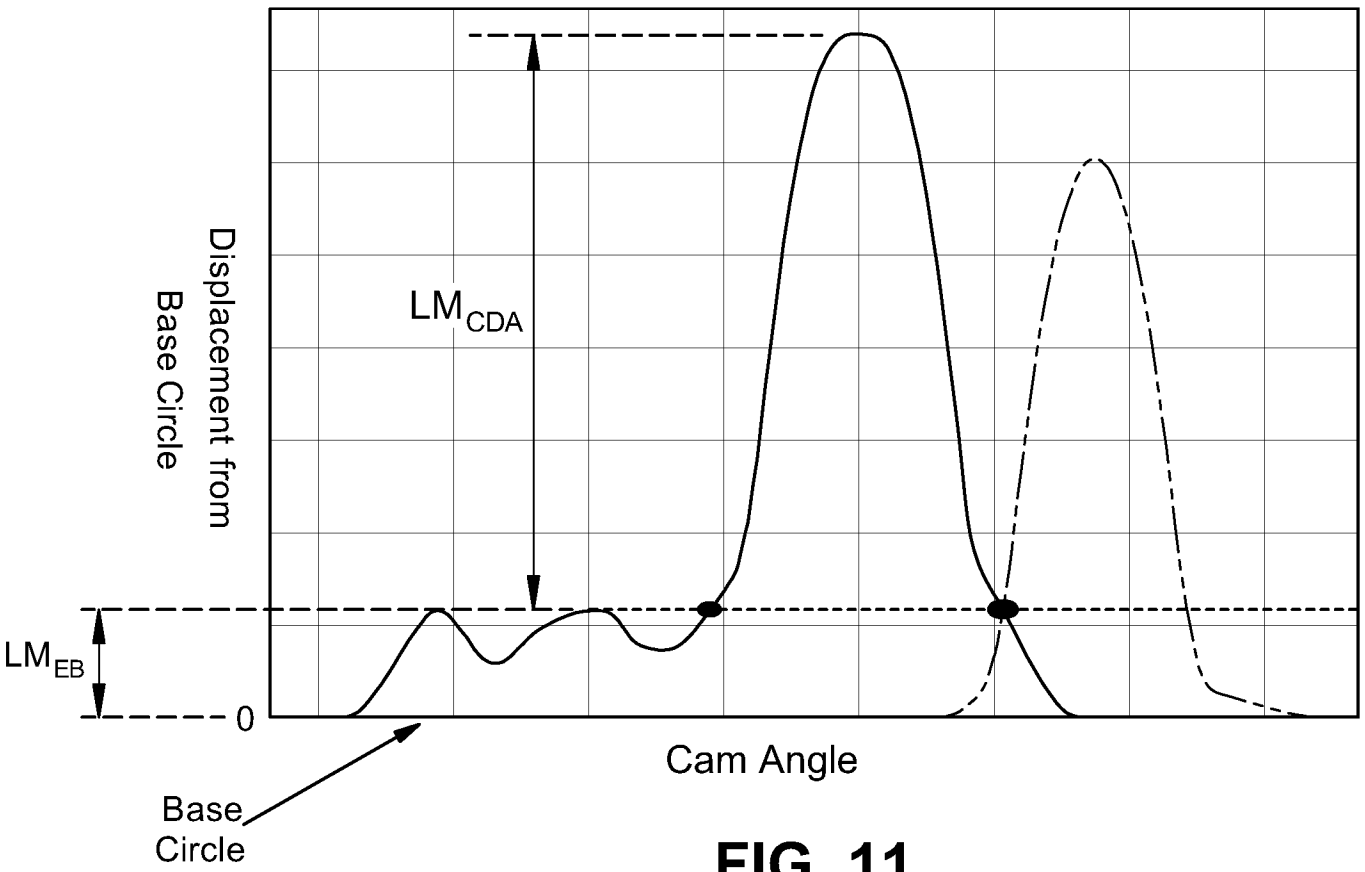
FIG. 11 is a graph of a displacement of a surface of a cam versus cam angle.

The first spline bushing 114 is configured to have a height H1 that corresponds to a total lost motion available for the first switchable castellation assembly 100. Referring to FIG. 11, the height H1 is selected to correspond to the sum of the distance required for the EB lost motion $LM_{EB}$ and the CDA function $LM_{CDA}$. The height H1 is calculated based on the EB lost motion $LM_{EB}$ and the CDA lost motion $LM_{CDA}$, as measured at the cam 18, adjusted for the distance $X_R$ that the roller 16 is from the shaft 14 and the distance $X_1$ that the first switchable castellation assembly 100 is from the shaft 14, see, FIG. 1. The equation below may be used to represent this relationship:

$$H1=(LM_{EB}+LM_{CDA})\times(X_1/X_R)$$

During the EB function, the first spline bushing 114 of the first switchable castellation assembly 100 is rotated to the locked position (FIG. 7) such that rotation of the rocker arm assembly 10 about the shaft 14 imparts motion to the valve end 22. This motion is transferred by the first switchable castellation assembly 100 through the movable insert 62 to the valve 24 to implement the EB function.

As noted above, the first switchable castellation assembly 100 is utilized for the EB function and the EB lost motion function and applies only to the valve 24. When in normal operation or the CDA function are engaged, the first spline bushing 114 returns to the unlocked position (FIGS. 8 and 9) such that the first switchable castellation assembly 100 does not cause movement of the valve 24, i.e., the valve 24 experience lost motion via the first switchable castellation assembly 100. When the first switchable castellation assembly 100 is in the unlocked position, movement or lost motion of the valve 24 is controlled by the second switchable castellation assembly 200, as described in detail below.

The second switchable castellation assembly 200 is utilized for normal operation and the CDA function for both valves 24, 26. In the embodiment illustrated, the second switchable castellation assembly 200 is positioned farther from the shaft 14 than the first switchable castellation assembly 100. The second switchable castellation assembly 200 is configured such that the first spline bushing 214 is in the locked position (FIG. 7), as described in detail above. In this position, movement of the rocker arm 12 about the shaft 14 is imparted to the first spline bushing 214.

As illustrated in FIG. 1, an end surface of the first spline bushing 214 is offset from an opposing end surface of the spline body 216 by a distance $D_{EB}$. The distance $D_{EB}$ is selected to be equal to a maximum distance that the end surface of the first spline bushing 214 will move during the EB function. In this respect, during movement of the rocker arm 12 during the EB function the second switchable castellation assembly 200 will internally collapse by the distance $D_{EB}$, thereby not transferring motion to the valve bridge 50.

A height H2 of the first spline bushing 214 corresponds to the lost motion experience by the valve bridge assembly 50 during the CDA function. Similar to H1, discussed in detail above, the height H2 is calculated based on the CDA lost motion $LM_{CDA}$, as measured at the cam 18, adjusted for the distance $X_R$ that the roller 16 is from the shaft 14 and the distance $X_2$ that the second switchable castellation assembly 200 is from the shaft 14, see, FIG. 1. The equation below may be used to represent this relationship:

$$H2=(LM_{EB}+LM_{CDA})\times(X_2/X_R)$$

During normal operation, the first spline bushing 214 is rotated to the locked position (FIG. 7) such that rotation of the rocker arm assembly 10 about the shaft 14 imparts motion to the valve end 22. This motion is transferred by the second switchable castellation assembly 200 to the valve bridge 50 which, in turn, moves both valves 24, 26.

During the CDA function, the first spline bushing 214 is rotated to the unlocked position (FIGS. 8 and 9) such that rotation of the rocker arm assembly 10 about the shaft 14 does not impart motion to the valve end 22. Instead, the spline body 216 moves into the first spline bushing 214 and the second switchable castellation assembly 200 and both valves 24, 26 (via the valve bridge assembly 50) experience lost motion.

In summary, the first switchable castellation assembly 100 and the second switchable castellation assembly 200 are configured such that the first switchable castellation assembly 100 is normally in a deactivated mode and the second switchable castellation assembly 200 is an activated mode. When the first and second switchable castellation assemblies 100, 200 are in this mode, movement of the rocker arm 12 causes force to be transferred from only the second switchable castellation assembly 200 to the valves 24, 26. The second switchable castellation assembly 200 may be deactivated (i.e., by moving the first spline bushing 214 to the unlocked position) to implement the CDA function.

When an EB function is desired, the first spline bushing 114 of the first switchable castellation assembly 100 is moved to the locked position. In this position, movement of the rocker arm 12 causes the first switchable castellation assembly 100 to move the valve 24, via the movable insert 62, without causing movement of the bridge 50. Because the first spline bushing 214 is offset from the spine body 216 by the distance $D_{EB}$, no force is transferred through the second switchable castellation assembly 200 to the valve bridge 50.

When it is desired to move both valves 24, 26, the first spline bushing 114 of the first switchable castellation assembly 100 is moved to the unlocked position and the first spline bushing 214 of the second switchable castellation assembly 200 is moved to the locked position. In this position, the second switchable castellation assembly 200 controls movement of the valves 24, 26 via the valve bridge 50.

In the embodiments illustrated, the first switchable castellation assembly 100 is positioned closer to the shaft 14 than the second switchable castellation assembly 200. It is contemplated that the first and second switchable castellation assemblies 100, 200 may be positioned the same distance from the shaft 14 or the first switchable castellation assembly 100 may be further from the shaft 14 than the second switchable castellation assembly 200.

It will be apparent to those skilled in the art that various modifications and variations can be made without departing from the spirit and scope of the claimed invention.

What we claim is:

1. A rocker arm assembly for an engine comprising:

a main body rotatable about a shaft, the main body having a roller end and a valve end;

a first switchable castellation assembly disposed in the valve end, the first switchable castellation assembly having a distal end configured to selectively move a first valve; and a second switchable castellation assembly disposed in the valve end, the second switchable castellation assembly having a distal end configured to engage a valve bridge assembly, the valve bridge assembly configured for engaging and actuating a second valve, wherein the first switchable castellation assembly and the second switchable castellation assembly each comprise:

a lost motion shaft, the lost motion shaft being configured to transfer a lift profile to the valve end; and a switchable castellation device, the switchable castellation device comprising:

a rotatable first spline bushing, and a spline body, wherein the first spline bushing is configured to switch between a locked position and an unlocked position, and wherein a lost motion is obtained by sliding the lost motion shaft when the first spline bushing is in the unlocked position.

2. The rocker arm assembly of claim 1, wherein the first valve is associated with an engine braking function.

3. The rocker arm assembly of claim 1, wherein the valve bridge assembly is configured for engaging and actuating the first valve.

4. The rocker arm assembly of claim 3, wherein the first valve and the second valve are associated with a cylinder deactivation function.

5. The rocker arm assembly of claim 3, wherein the first valve is movable independent of the valve bridge assembly.

6. The rocker arm assembly of claim 1, the first switchable castellation assembly being positioned closer to the shaft than the second switchable castellation assembly.

7. The rocker arm assembly of claim 1, wherein the rotatable first spline bushing of the first switchable castellation assembly has a height equal to a sum of a distance required for lost motion of the first valve during an engine braking function of the first valve and a distance required for lost motion of the first valve during a cylinder deactivation function of the first valve.

8. The rocker arm assembly of claim 1, wherein the rotatable first spline bushing of the second switchable castellation assembly has a height equal to a sum of a distance required for lost motion of the second valve during a cylinder deactivation function of the second valve.

9. The rocker arm assembly of claim 1, wherein a bottom surface of the first spline bushing is offset from an upper surface of the spline body by a distance required for lost motion of the second valve during an engine braking function of the first valve.

10. The rocker arm assembly of claim 1, wherein a default position of the first spline bushing of the first switchable castellation assembly is the unlocked position.

11. The rocker arm assembly of claim 1, wherein a default position of the first spline bushing of the second switchable castellation assembly is the locked position.

12. The rocker arm assembly of claim 1, the first switchable castellation assembly and the second switchable castellation assembly each further comprising a lost motion spring, wherein the lost motion spring is configured to bias the lost motion shaft to a fully extended position, and wherein the lost motion spring is configured to collapse during the lost motion.

13. The rocker arm assembly of claim 1, the first switchable castellation assembly and the second switchable castellation assembly each further comprising an actuator for rotating the first spline bushing between the locked position and the unlocked position.

14. A method of operating a rocker arm assembly during an engine braking function, an engine braking lost motion function, a normal operation mode, and a cylinder deactivation function, the rocker arm assembly comprising: a main body rotatable about a shaft, the main body having a roller end and a valve end; a first switchable castellation assembly disposed in the valve end, the first switchable castellation assembly having a distal end configured to selectively move a first valve, the first switchable castellation assembly movable between a deactivated position wherein rotation of the main body about the shaft is not transferred to the first valve via the first switchable castellation assembly and an activated position wherein rotation of the main body about the shaft is transferred to the first valve via the first switchable castellation assembly; and a second switchable castellation assembly disposed in the valve end, the second switchable castellation assembly having a distal end configured to engage a valve bridge assembly, the valve bridge assembly configured for engaging and actuating a second valve, the second switchable castellation assembly movable between an activated position wherein rotation of the main body about the shaft is transferred to the second valve via the valve bridge assembly and the second switchable castellation assembly and a deactivated position wherein rotation of the main body about the shaft is not transferred to the second valve via the valve bridge assembly and the second switchable castellation assembly, the method comprising;

for the engine braking function:

1) Moving the first switchable castellation assembly to the activated position; and 2) Rotating the main body a predetermined distance sufficient to actuate the first valve via the first switchable castellation assembly for the engine braking function wherein the second switchable castellation assembly internally collapses to prevent a transfer of motion to the valve bridge assembly via the second switchable castellation assembly, for the engine braking lost motion function 1) Moving the first switchable castellation assembly to the deactivated position; and 2) Rotating the main body the predetermined distance sufficient to actuate the first valve via the first switchable castellation assembly for the engine braking function wherein the first switchable castellation assembly experiences lost motion and motion is not transferred to the first valve via the first switchable castellation assembly and wherein the second switchable castellation assembly internally collapses to prevent a transfer of motion to the valve bridge assembly via the second switchable castellation assembly, for the normal operation mode:

1) Moving the first switchable castellation assembly to the deactivated position and the second switchable castellation assembly to the activated position, and 2) Rotating the main body a predetermined distance sufficient to actuate the second valve via the second switchable castellation assembly for the normal operation mode wherein the first switchable castellation assembly experiences lost motion and motion is not transferred to the first valve via the first switchable castellation assembly, and for the cylinder deactivation function:

1) Moving the first switchable castellation assembly to the deactivated position and the second switchable castellation assembly to the deactivated position; and 2) Rotating the main body the predetermined distance sufficient to actuate the second valve via the second switchable castellation assembly for the normal operation mode wherein the first valve experiences lost motion via the first switchable castellation assembly and the second valve experiences lost motion via the second switchable castellation assembly.

15. The method of claim 14, the first switchable castellation assembly and the second switchable castellation assembly each comprising:

a lost motion shaft, the lost motion shaft being configured to transfer a lift profile to the valve end; and a switchable castellation device, the switchable castellation device comprising:

a rotatable first spline bushing, and a spline body, wherein the first spline bushing is configured to switch between a locked position and an unlocked position, and wherein a lost motion is obtained by sliding the lost motion shaft when the first spline bushing is in the unlocked position.

16. The method of claim 15, wherein the rotatable first spline bushing of the first switchable castellation assembly has a height equal to a sum of a distance required for lost motion of the first valve during the engine braking lost motion function and a distance required for lost motion of the first valve during the cylinder deactivation function.

17. The method of claim 15, wherein the rotatable first spline bushing of the second switchable castellation assembly has a height equal to a sum of a distance required for lost motion of the second valve during the cylinder deactivation function of the second valve.

18. The method of claim 15, wherein the collapsing of the second switchable castellation assembly during the engine braking lost motion function is achieved by offsetting a bottom surface of the first spline bushing from an upper surface of the spline body a predetermined distance.

* * * * *